US008920204B2

(12) United States Patent
Durante

(10) Patent No.: US 8,920,204 B2
(45) Date of Patent: Dec. 30, 2014

(54) FIN PLUG ASSEMBLY AND METHOD OF INSTALLATION

(75) Inventor: Michael Durante, Mona Vale (AU)

(73) Assignee: Fin Control Systems Pty. Limited, New South Wales (AU)

( * ) Notice: Subject to any disclaimer, the term of this patent is extended or adjusted under 35 U.S.C. 154(b) by 1268 days.

(21) Appl. No.: 12/672,984

(22) PCT Filed: Aug. 5, 2008

(86) PCT No.: PCT/AU2008/001132
§ 371 (c)(1),
(2), (4) Date: Nov. 14, 2011

(87) PCT Pub. No.: WO2009/021267
PCT Pub. Date: Feb. 19, 2009

(65) Prior Publication Data

US 2012/0052755 A1 Mar. 1, 2012

(30) Foreign Application Priority Data

Aug. 10, 2007 (AU) ..... 2007904295

(51) Int. Cl.
*B63B 35/79* (2006.01)

(52) U.S. Cl.
CPC ..... *B63B 35/793* (2013.01)
USPC ..... 441/79

(58) Field of Classification Search
CPC B63B 35/79; B63B 35/7906; B63B 35/7909; B63B 35/7926; B63B 35/793; B63B 35/7933; B63B 39/06; B63B 39/061; B63B 39/062; B63B 41/00
USPC ..... 441/74, 79
See application file for complete search history.

(56) References Cited

U.S. PATENT DOCUMENTS

| | | | | |
|---|---|---|---|---|
| 3,579,681 | A * | 5/1971 | Pope et al. | 441/79 |
| 4,804,347 | A | 2/1989 | Ross | |
| 4,904,215 | A * | 2/1990 | Sherwood | 441/79 |
| 5,464,359 | A | 11/1995 | Whitty | |
| 5,830,025 | A * | 11/1998 | Fleming | 441/79 |
| 6,139,383 | A * | 10/2000 | Jolly et al. | 441/74 |
| 6,386,933 | B1 * | 5/2002 | Rewald et al. | 441/74 |
| 6,991,503 | B2 * | 1/2006 | Garcia | 441/79 |
| 7,108,571 | B2 | 9/2006 | Geraghty | |
| D635,630 | S * | 4/2011 | Durante | D21/771 |
| 2004/0248482 | A1 | 12/2004 | Larkin | |
| 2006/0019559 | A1 | 1/2006 | Mair et al. | |

FOREIGN PATENT DOCUMENTS

| | | | | |
|---|---|---|---|---|
| DE | 3239441 | A1 | 5/1984 | |
| FR | 2659931 | A1 * | 9/1991 | B63B 39/06 |

OTHER PUBLICATIONS

Machine translation of DE 3239441.*

* cited by examiner

*Primary Examiner* — Ajay Vasudeva
(74) *Attorney, Agent, or Firm* — Knobbe, Martens, Olson & Bear LLP

(57) ABSTRACT

A fin plug assembly, for a surfcraft, including:

a fin plug including a flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity; and a high density foam body having an upper surface with a fin plug cavity in said upper surface and a continuous side wall;

wherein the base portion of the fin plug is located within said fin plug cavity and said fin plug is firmly affixed to said high density foam body.

47 Claims, 2 Drawing Sheets

FIN PLUG ASSEMBLY AND METHOD OF INSTALLATION

CROSS REFERENCE TO RELATED APPLICATIONS

This application claims the benefit and priority to and is a U.S. National Phase of PCT International Application Number PCT/AU2008/001132, filed on Aug. 5, 2008, which claims priority to Australian Patent Application No. AU2007904295 filed on Aug. 10, 2007. The disclosures of the above-referenced application are hereby expressly incorporated by reference in their entirety.

FIELD OF THE INVENTION

The present invention relates to a fin plug assembly for installation in a surfcraft, such as a surfboard. The subject fin plug assembly is adapted to removably secure a surfcraft fin to the surfcraft. The present invention also relates to a method of installing said fin plug assembly into the body of a surfcraft.

BACKGROUND OF THE INVENTION

In this specification, where a document, act or item of knowledge is referred to or discussed, this reference or discussion is not an admission that the document, act or item of knowledge or any combination thereof was at the priority date:

(i) part of common general knowledge; or (ii) known to be relevant to an attempt to solve any problem with which this specification is concerned.

Most surfcraft (including surfboards) have one or more fins located on an underside of the surfcraft for controlling the direction and facilitating turning of the surfcraft. Some surfcraft have the fins integrally formed on the surfcraft. In recent times however it has become more common for surfcraft to incorporate fin systems which include removable fins. Such systems have numerous benefits including enabling the fins to be removed whilst travelling, allowing damaged fins to be easily replaced and enabling fins of different shapes or styles to be selectively used. Such fin systems typically include a fin plug embedded into the underside of the surfcraft. This fin plug generally has at least one cavity adapted to receive a base portion (or a base element) of a surfcraft fin. The surfcraft fin is attached to the surfcraft by securing the base portion (or base element) of the fin into the cavity (or cavities) of the fin plug. There are numerous known fin systems which adopt this arrangement.

One such known fin system is described in U.S. Pat. No. 5,464,359 in the name of Fin Control Systems Pty Ltd. This system includes fins having 2 projecting base elements (or tabs) and, for each fin, two fin plugs installed in the underside of the surfcraft. Each of the fin plugs has a cavity for receiving one of the base elements. Each fin plug also includes means for securing the base element into the cavity.

Other known fin systems comprise a single fin plug, with a single cavity, for each fin. Typically, such a fin system has quite a large tin plug with an elongated fin cavity for receiving the base element of the fin. The fin plug of such systems also typically includes an upper flat portion having an opening from which the fin cavity extends inwardly and a flange section extending laterally about the opening. This flange section has a particular width. Extending downwardly from an underside of the flat upper portion is a body portion which surrounds the fin cavity. The shape of such a fin plug generally requires two cavities to be routed into the underside of the surfcraft in a two step process. Firstly, a relatively wide, shallow cavity needs to be formed, the dimensions of which substantially correspond to the shape of the flange section. The depth of this first cavity will substantially correspond with the width of the flange section. Secondly, a narrow, deeper cavity needs to be formed in the first mentioned cavity, which is adapted to receive the body portion of the fin plug. As most surfcraft are designed to accommodate three fins, having to adopt this two step process for forming each fin plug cavity in the surfcraft substantially slows down the installation process.

These large fin plugs with elongated cavities can also cause other problems in the surfcraft into which they are installed. For instance, when one of these large fin plugs is used for the side fins of a surfboard, a rear section of the fin plug is necessarily positioned very close to the side rail of the surfboard. This makes installation of the fin plug more difficult and may cause the surfboard maker to compromise the positioning of the fin plug. Also, the size and length of such a fin plug causes there to be a very significant flex differential between the fin plug and the surfboard blank into which the plug is installed. This creates a defined weak point near the tail of the surfboard. Another problem caused by the length of such a fin plug is that the 'shapers dot' (which defines the location of the trailing edge of a fin) on the surfboard blank is removed due to the size of the fin plug cavity routed into the blank. This can give rise to doubts as to whether the fin plug has been correctly positioned in the surfboard.

A further problem with known fin plugs is that they are surrounded by the relatively low density foam of which the surfcraft is formed. Such foam does not generally provide sufficient strength to support the loads placed upon the fin plug, due to forces applied to the attached fin, without some deformation or weakening of the surrounding foam over time. Such deformation or weakening of the foam can cause the fin plug to sink into the foam or to shift out of alignment, with consequential reduction in performance of the attached fin. This can also cause the fibreglass skin, in the vicinity of the fin plug, to crack or shatter. Also, when the fin plug sinks into the foam body, it can cause the top surface of the plug to delaminate from the adjoining fiberglass layer.

The present invention is directed towards ameliorating at least some of the above described problems associated with prior art fin plugs and, consequently, the methods of installing these. In particular, the present invention is directed towards providing a fin plug assembly which is relatively lightweight and strong and which is easier to install than many known fin plugs.

SUMMARY OF THE INVENTION

According to a first aspect of the present invention, there is provided a fin plug assembly, for a surfcraft, including:

a fin plug including a substantially flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity; and a high density foam body having an upper surface, a lower surface, a fin plug cavity extending from said upper surface to said lower surface, and a continuous side wall having a perimeter substantially equivalent to the external perimeter of the flat upper portion, said continuous side wall extending about said foam body and between said upper surface and said lower surface;

wherein the base portion of the fin plug is located within said fin plug cavity and said fin plug is firmly affixed to said high density foam body.

According to a second aspect of the present invention, there is provided a fin plug assembly kit, including:

a fin plug including a substantially flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity; and a high density foam body having an upper surface, a lower surface, a fin plug cavity extending from said upper surface to said lower surface, and a continuous side wall having a perimeter substantially equivalent to the external perimeter of the flat upper portion, said continuous side wall extending about said foam body and between said upper surface and said lower surface;

wherein the fin plug cavity is adapted to receive the base portion of the fin plug and said fin plug and said high density foam body are adapted to be adhered to one another.

One of the benefits of the above fin plug assembly is that the high density foam body provides significant support to the fin plug. The high density foam body is able to absorb, or provide a buffer against, forces applied to the (or each) fin cavity, via external forces applied to the attached fin, far better than (relatively low density) foam of which most surfboard blanks are formed.

Preferably, the sidewall of the high density foam body has a profile which is substantially identical to the external perimeter of the flat upper portion of the fin plug. In this arrangement, the perimeter of the fin plug and the continuous side wall of the high density foam body (to which the fin plug is affixed) are in substantial alignment. As is explained elsewhere below, this enables the fin plug assembly to be more simply installed into a surfcraft blank by enabling a single assembly cavity to be formed in the surfcraft blank so that the top surface of the fin plug is flush with a surrounding surface of the surfcraft blank.

Preferably, the flat upper portion of the fin plug includes a flange extending laterally from said at least one opening to the external perimeter. It is further preferred that the fin plug includes two fin cavities for receiving two base elements of a surfcraft fin, said fin cavities extending inwardly from two openings in the top surface. In this embodiment, the flange is preferably wider around the two openings than between the openings. This results in the external perimeter of the flat upper portions having a substantially hour-glass profile (i.e. wider adjacent the ends and narrower near the centre). One benefit of this shape is that, in the event that an assembly cavity (for receiving the fin plug assembly) formed in the surfcraft body is poorly formed, the fin plug assembly can pivot slightly about a central point which allows for the toe angle for the fin to be correctly set and for the trailing edge of the fin to accurately located on the 'shapers dot'.

Typically, the fin plug further includes securing means for removably securing the base element of the surfcraft fin within said at least one cavity. The securing means may include a grub screw arrangement consisting of a screw cavity and a grub screw located therein, said grub screw arrangement being adapted to selectively position the grub screw tightly against the base element of the surfcraft fin. The grub screw arrangement is preferably adapted so that the grub screw applies lateral pressure to the base element of the surfcraft fin.

The base portion of the fin plug may also include at least one ribbed section on an external surface for enhancing engagement with a liquid adhesive material, such as hardenable liquid resin. This ribbed section enables liquid resin to extend into gaps between the ribs so that when the resin is hardened, the base portion is secured more firmly into a surrounding cavity.

The flat upper portion of the plug may further include holes therethrough adapted to receive liquid resin during a process of installing the fin plug. Having liquid resin (which later hardens in position) extend into these holes assists further in securing the fin plug in its desired position.

Preferably, the fin plug further includes at least one cap adapted to cover said at least one fin cavity and screw cavity. In this embodiment, the fin plug also preferably includes a ramp section extending upwardly from the top surface of the flat upper portion and located about said at least one opening. When the fin plug includes two fin cavities, the fin plug will desirably have two caps, each cap covering one of the fin cavities and the adjoining screw cavity, and a ramp section about each of the openings.

The fin plug is generally formed of a strong, rigid plastic. The high density foam body is generally formed of polyurethane, EPS, PVC or PET foam. Preferably the high density foam body has a density of at least 70 kg/m3.

According to a third aspect of the present invention, there is provided a method of installing the fin plug assembly described above into a surfcraft body, said method including:

forming an assembly cavity in a predetermined position in an underside of the surfcraft body where a surfcraft fin is to be located, said assembly cavity being of substantially uniform profile throughout, said profile being substantially identical to the profile of the continuous side wall of the high density foam body;

applying an adhesive material within the assembly cavity; and inserting the fin plug assembly into the assembly cavity.

According to a fourth aspect of the present invention, there is provided a method of installing the fin plug and high density foam body of the kit described above into a surfcraft body, said method including:

forming an assembly cavity in a predetermined position in an underside of the surfcraft body where a surfcraft fin is to be located, said assembly cavity being of substantially uniform profile throughout, said profile being substantially identical to the profile of the continuous side wall of the high density foam body;

applying an adhesive material within the fin plug cavity of the high density foam body;

inserting the base portion of the fin plug into the fin plug cavity and seating the flat upper portion on the upper surface of the high density foam body so that the external perimeter of the flat upper portion is in substantial alignment with the continuous side wall of the high density foam body;

applying an adhesive material within the assembly cavity; and inserting the high density foam body into the assembly cavity.

When forming the assembly cavity in the underside of the surfcraft, it is preferred that the depth of the cavity is such that, when said fin plug assembly is inserted into the assembly cavity, the top surface of the flat upper portion of the fin plug is substantially flush with an adjoining surface of the underside of said surfcraft body.

Preferably, the adhesive material used in the above methods is a hardenable liquid resin. It is preferred that the hardenable liquid resin is caused to flow into the holes in the flat upper portion of the fin plug. It is further preferred that the hardenable liquid resin is also applied between the bottom surface of the flat upper portion and the upper surface of the high density foam body so as to further enhance the adhesion of the fin plug to the high density foam body.

The step of forming the assembly cavity preferably includes the use of a template positioned on the underside of the surfcraft body, said template including a shaped hole therethrough, said hole having a profile which is substantially identical to the external perimeter of the flat upper portion of the fin plug.

It is preferred that the surfcraft body used in the above methods is a foam blank. The foam blank may be formed of polyurethane, PVC or EPS foam. The foam blank typically has a density of between 30 and 50 kg/m3. About 40 kg/m3 is a preferred density for the foam blank.

According to a fifth aspect of this invention, there is provided a surfboard having at least one fin plug assembly described above installed therein.

BRIEF DESCRIPTION OF THE DRAWINGS

A preferred embodiment of the invention will now be further explained and illustrated by reference to the accompanying drawings in which.

DETAILED DESCRIPTION OF A PREFERRED EMBODIMENT OF THE INVENTION

A preferred embodiment of the invention will now be described with reference to the above drawings.

Figure 1:
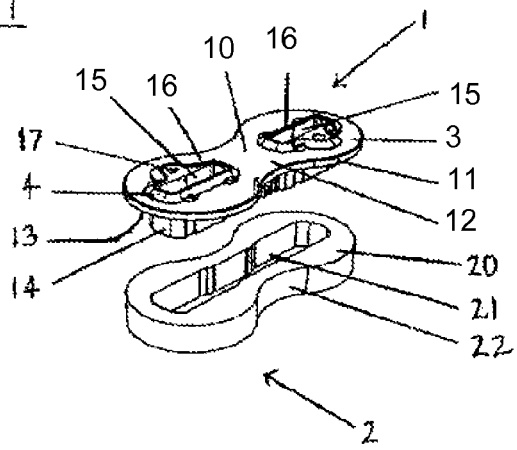
FIG. 1 is a top perspective exploded view of the fin plug assembly according to the present invention.
Figure 2:
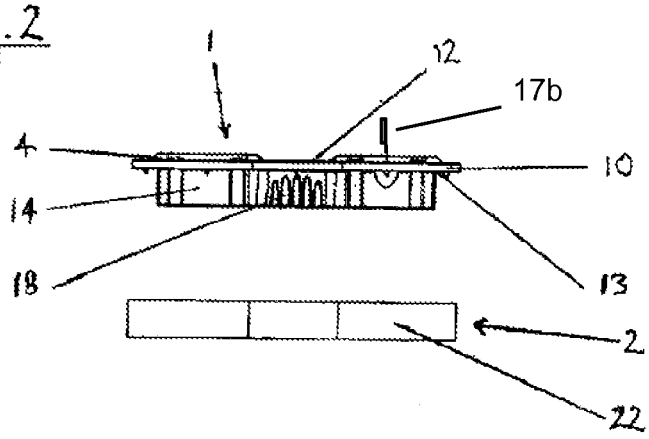
FIG. 2 is a side exploded view of the fin plug assembly shown in FIG. 1.
Figure 3:
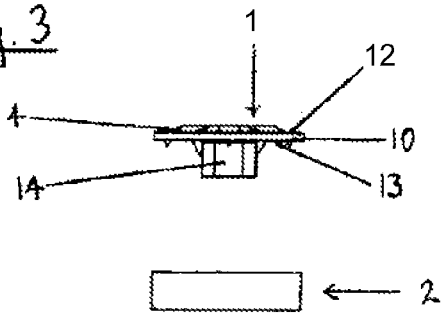
FIG. 3 is an end exploded view of the fin plug assembly shown in FIG. 1.

FIGS. 1, 2 and 3 show an exploded view of a fin plug assembly according to a preferred embodiment of the present invention. The fin plug assembly includes a fin plug 1 and a high density foam body 2. The fin plug 1 comprises a flat upper portion 10 having an external perimeter 11. The upper portion 10 has a top surface 12 and a bottom surface 13. Extending downwardly from the bottom surface 13 is a base portion 14. The fin plug 1 also has a pair of aligned fin cavities 15 which extend inwardly from fin cavity openings 16 in the top surface 12 of the flat upper portion 10.

The fin plug 1 also has a threaded screw cavity 17, having an opening in the top surface 12, adjacent to each fin cavity opening 16. Each screw cavity 17 is in communication with the adjacent fin cavity 15 and is adapted to receive a grub screw 17*b*, (FIG. 2) which is able to extend down through the screw cavity 17 and, at least partially, into said fin cavity 15 for securing a base portion of a fin therein.

Located about each fin cavity opening 16 and adjacent screw cavity 17 opening is a ramp section 4. The purpose of the ramp section 4 is to facilitate the finishing off of the surfcraft after installation of the fin plug assembly. Once the fin plug assembly is installed, fibreglass and resin are applied to the outside surfaces of the shaped foam blank. The fibreglass and resin are able to cover the fin plug (with caps covering the fin cavities and the screw cavities). The ramp sections (and caps) cause slight mounds to occur in the surface of the underside of the glassed surfcraft. These mounds can easily then be sanded down to be flush with the surface of the underside of the surfcraft.

The flat upper portion 10 also includes a flange 3 extending laterally from the fin cavity openings 16 to the external perimeter 11. This flange 3 is wider in the regions surrounding the fin cavity openings 16. This is because the forces experienced by the fin plug, from external forces applied to the attached fin, will be greatest around the fin cavity openings 16 (which accommodate the base elements of the fin). Accordingly, having a wider flange in these regions helps to dissipate the forces over a wider area, thereby further minimising the potential for deformation of the adjacent high density foam body 2.

As shown in FIGS. 1 and 2, outer surfaces of the base portion 14 have ribbed sections 18. These ribbed sections 17 enable hardenable liquid resin to permeate between the ribs, thereby enabling greater adhesion of the fin plug 1 to the high density foam body 2.

Figure 4:
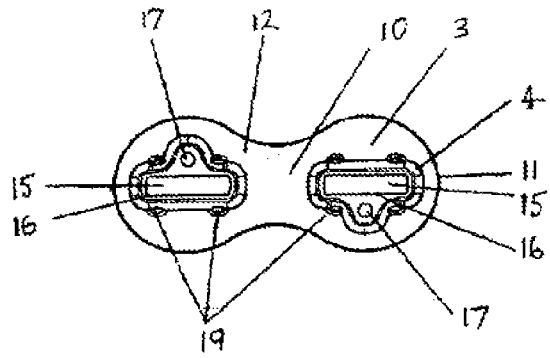
FIG. 4 is a top view of a fin plug of the fin plug assembly shown in FIG. 1.
Figure 5:
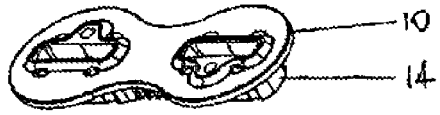
FIG. 5 is a top perspective view of the fin plug shown in FIG. 4.
Figure 6:
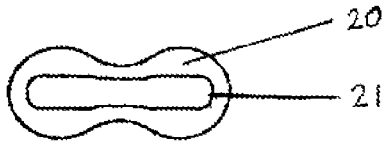
FIG. 6 is a top view of a high density foam body of the fin assembly shown in FIG. 1.
Figure 7:
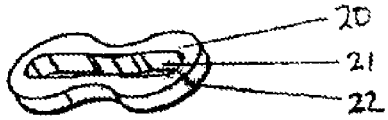
FIG. 7 is a top perspective view of the high density foam body shown in FIG. 6.
Figure 8:
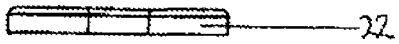
FIG. 8 is a side view of the high density foam body shown in FIG. 6.

As is more clearly shown in FIG. 4, the flat upper portion 10 of the fin plug 1 includes holes 19 therethrough. These holes 19 enable hardenable liquid resin to permeate into them, during the installation process, further enhancing the adhesion and mechanical bond of the fin plug 1 to the high density foam insert 2.

The high density foam body 2 has an upper surface 20 and a fin plug cavity 21 formed in the upper surface 20. This fin plug cavity 21 is adapted to receive the base portion 14 of the fin plug 1. The bottom surface 13 of the flat upper portion 10 of the fin plug is adapted to sit against, and be affixed to, the upper surface 20 of the high density foam body 2. The high density foam body 2 also has a continuous side wall 22 which, as can be seen, has the same profile as the external perimeter 11 of the flat upper portion 10 of the fin plug 1. Having the same profile enables the continuous side wall 22 to be in alignment with, and extend downwardly from, the external perimeter 11 of the flat upper portion 10 when the fin plug 1 is affixed to the high density foam body 2.

Modifications and improvements to the invention will be readily apparent to those skilled in the art. Such modifications and improvements are intended to be within the scope of this invention.

The claims defining the invention are as follows:

1. A fin plug assembly, for a surfcraft, including:

a fin plug including a substantially flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity; and a high density foam body having an upper surface, a lower surface, a fin plug cavity extending from said upper surface to said lower surface, and a continuous side wall having a perimeter substantially equivalent to the external perimeter of the flat upper portion, said continuous side wall extending about said foam body and between said upper surface and said lower surface;

wherein the base portion of the fin plug is located within said fin plug cavity and said fin plug is firmly affixed to said high density foam body.

2. A fin plug assembly according to claim 1 wherein the continuous side wall of the high density foam body and the external perimeter of the substantially flat upper portion of the fin plug are in substantial vertical alignment.

3. A fin plug assembly according to claim 1 wherein the substantially flat upper portion of the fin plug includes a flange extending laterally from said at least one opening to said external perimeter.

4. A fin plug assembly according to claim 3 wherein said at least one fin cavity the fin plug includes two fin cavities and said at least one opening in the top surface includes two openings, wherein said two fin cavities are arranged for receiving two base elements of a surfcraft fin, said fin cavities extending inwardly from two openings in the top surface.

5. A fin plug assembly according to claim 4 wherein the flange is wider around the two openings than between the openings.

6. A fin plug assembly according to claim 1 wherein the fin plug further includes securing means for removably securing the base element of a surfcraft fin within said at least one cavity.

7. A fin plug assembly according to claim 6 wherein the securing means includes a grub screw arrangement consisting of a screw cavity and a grub screw located therein, said grub screw arrangement being adapted to selectively position the grub screw tightly against the base element of the surfcraft fin.

8. A fin plug assembly according to claim 7 wherein the grub screw arrangement is adapted so that the grub screw applies lateral pressure to the base element of the surfcraft fin.

9. A fin plug assembly according to claim 1 wherein the base portion of the fin plug further Includes at least one ribbed section on an external surface for enhancing engagement with a liquid adhesive material.

10. A fin plug assembly according to claim 1 wherein the fin plug is affixed to the high density foam body by a hardenable liquid resin.

11. A fin plug assembly according to claim 10 wherein the substantially flat upper portion of the fin plug further include holes therethrough adapted to receive the hardenable liquid resin during a process of installing the fin plug.

12. A fin plug assembly according to claim 1 wherein the fin plug further includes at least one ramp section extending upwardly from the top surface of the substantially flat upper portion and located about said at least one opening.

13. A fin plug assembly according to claim 1 wherein the fin plug is formed of a strong, rigid plastic.

14. A fin plug assembly according to claim 1 wherein the high density foam body is formed of polyurethane, EPS, PVC or PET foam.

15. A fin plug assembly according to claim 14 wherein the high density foam body has a density of at least 70 kg/m3.

16. A method of installing the fin plug assembly according to claim 1, said method including:

forming an assembly cavity in a predetermined position in an underside of a surfcraft body where a surfcraft fin Is to be located, said assembly cavity being of uniform profile throughout, said profile being substantially identical to the profile of the continuous side wall of the high density foam body;

applying an adhesive material within the assembly cavity; and inserting the fin plug assembly into the assembly cavity.

17. A method according to claim 16 wherein the assembly cavity is formed so as to have a depth such that, when said fin plug assembly is inserted into the assembly cavity, the top surface of the flat upper portion of the fin plug is substantially flush with an adjoining surface of the underside of said surfcraft body.

18. A method according to claim 17 wherein the adhesive material is a hardenable liquid resin.

19. A method according to claim 18 wherein the hardenable liquid resin is caused to flow into the holes in the flat upper portion of the fin plug.

20. A method according to claim 19 wherein the hardenable liquid resin is also applied between the bottom surface of the flat upper portion of the fin plug and the upper surface of the high density foam body.

21. A method according to claim 16 wherein the step of forming the assembly cavity includes the use of a template positioned on the underside of the surfcraft body, said template including a shaped hole therethrough having a profile which is substantially identical to the external perimeter of the flat upper portion of the fin plug.

22. A method according to claim 16 wherein the surfcraft body is a foam blank.

23. A method according to claim 22 wherein the foam blank is formed of polyurethane, PVC or EPS foam.

24. The method according to claim 23 wherein the foam blank has a density of between 30 and 50 kg/m3.

25. A surfcraft having at least one fin plug assembly, according to claim 1, installed therein.

26. A surfcraft according to claim 25 wherein the surfcraft is a surfboard.

27. A fin plug assembly kit, including;

a fin plug including a substantially flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity; and a high density foam body having an upper surface, a lower surface, a fin plug cavity extending from said upper surface to said lower surface, and a continuous side wall having a perimeter substantially equivalent to the external perimeter of the flat upper portion, said continuous side wall extending about said foam body and between said upper surface and said lower surface;

wherein the fin plug cavity is adapted to receive the base portion of the fin plug and said fin plug and said high density foam body are adapted to be adhered to one another.

28. A fin plug assembly kit according to claim 27 wherein the continuous side wall of the high density foam body and the external perimeter of the substantially flat upper portion of the fin plug are in substantial vertical alignment.

29. A fin plug assembly kit according to claim 27 wherein the substantially flat upper portion of the fin plug includes a flange extending laterally from said at least one opening to said external perimeter.

30. A fin plug assembly kit according to claim 29 wherein said at least one fin cavity the fin plug includes two fin cavities and said at least one opening in the top surface includes two openings, wherein said two fin cavities are arranged for receiving two base elements of a surfcraft fin, said fin cavities extending inwardly from two openings in the top surface.

31. A fin plug assembly kit according to claim 30 wherein the flange is wider around the two openings than between the openings.

32. A fin plug assembly kit according to claim 27 wherein the fin plug further includes securing means for removably securing the base element of a surfcraft fin within said at least one cavity.

33. A fin plug assembly kit according to claim 32 wherein the securing means includes a grub screw arrangement consisting of a screw cavity and a grub screw located therein, said grub screw arrangement being adapted to selectively position the grub screw tightly against the base element of the surfcraft fin.

34. A fin plug assembly kit according to claim 33 wherein the grub screw arrangement is adapted so that the grub screw applies lateral pressure to the base element of the surfcraft fin.

35. A fin plug assembly kit according to claim 27 wherein the base portion of the fin plug further includes at least one ribbed section on an external surface for enhancing engagement with a liquid adhesive material.

36. A fin plug assembly kit according to claim 27 wherein the fin plug is affixable to the high density foam body by a hardenable liquid resin.

37. A fin plug assembly kit according to claim 36 wherein the substantially flat upper portion of the fin plug further include holes therethrough adapted to receive hardenable liquid resin during a process of installing the fin plug.

38. A fin plug assembly kit according to claim 33 wherein the fin plug further includes at least one cap adapted to cover said at least one fin cavity and screw cavity.

39. A fin plug assembly kit according to claim 27 wherein the fin plug further includes at least one ramp section extending upwardly from the top surface of the flat upper portion and located about said at least one opening.

40. A fin plug assembly kit according to claim 27 wherein the fin plug is formed of a strong, rigid plastic.

41. A fin assembly kit according to claim 27 wherein the high density foam body is formed of polyurethane, EPS, PVC or PET foam.

42. A fin assembly kit according to claim 41 wherein the high density foam body has a density of at least 70 kg/m3.

43. A method of installing the fin plug and high density foam body of the kit described in claim 27, said method including:

forming an assembly cavity in a predetermined position in an underside of a surfcraft body where a surfcraft fin is to be located, said assembly cavity being of uniform profile throughout, said profile being substantially Identical to the profile of the continuous side wall of the high density foam body;

applying an adhesive material within the fin plug cavity of the high density foam body;

inserting the base portion of the fin plug into the fin plug cavity and seating the flat upper portion on the upper surface of the high density foam body so that the external perimeter of the flat upper portion is in alignment with the continuous side wall of the high density foam body;

applying an adhesive material within the assembly cavity; and inserting the high density foam body into the assembly cavity.

44. A fin plug assembly, for a surfcraft, including:

a fin plug including a substantially flat upper portion having an external perimeter and top and bottom surfaces, at least one fin cavity for receiving a base element of a surfcraft fin extending inwardly from at least one opening in the top surface, a base portion extending from said bottom surface and surrounding said at least one fin cavity, the substantially flat upper portion of the fin plug including a flange extending laterally from said at least one opening to said external perimeter; and a foam body having an upper surface, a lower surface, a fin plug cavity extending from said upper surface towards said lower surface, and an outer side wall extending about said foam body and between said upper surface and said lower surface, said side wall having a profile substantially the same as the external perimeter of the flat upper portion so that the side wall and the external perimeter are substantially in vertical alignment;

wherein the base portion of the fin plug is located within said fin plug cavity and said fin plug is firmly affixed to said foam body.

45. A fin plug assembly according to claim 44 wherein the fin plug includes a grub screw arrangement for removably securing the base element of the surfcraft fin within the at least one cavity, the grub screw arrangement comprising a screw cavity extending between the fin plug top surface and the at least one fin cavity, and a grub screw within the screw cavity adapted for tightening against the base element to secure the surfcraft fin.

46. A fin plug assembly according to claim 44, wherein the upper portion includes a raised ramp section surrounding said at least one fin cavity opening.

47. A method of installing the fin plug assembly according to claim 44, said method including:

forming an assembly cavity in a predetermined position in an underside of a surfcraft body where a surfcraft fin is to be located, said assembly cavity being of uniform profile throughout, said assembly cavity profile being substantially identical to the profile of the outer side wall of the foam body and wherein the assembly cavity has a depth such that, when the fin plug assembly is inserted into the assembly cavity, the top surface of the flat upper portion is substantially aligned with an adjacent surface of the underside of the surfcraft body.

* * * * *